US006809304B2

(12) United States Patent
Besmann et al.

(10) Patent No.: US 6,809,304 B2
(45) Date of Patent: Oct. 26, 2004

(54) HIGH EFFICIENCY, OXIDATION RESISTANT RADIO FREQUENCY SUSCEPTOR

(75) Inventors: Theodore M. Besmann, Oak Ridge, TN (US); James W. Klett, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 10/822,946

(22) Filed: Apr. 13, 2004

(65) Prior Publication Data

US 2004/0188425 A1 Sep. 30, 2004

Related U.S. Application Data

(63) Continuation of application No. 10/082,668, filed on Feb. 25, 2002, now abandoned.

(51) Int. Cl.[7] ..... H05B 6/10
(52) U.S. Cl. ..... 219/634; 219/730
(58) Field of Search ..... 219/634, 730; 428/340.4, 71, 334; 427/249.15, 249.19, 189, 452, 253; 423/455 R, 448, 402; 264/29.6, 29.7, 42–43, 101–102; 156/78, 245, 345.1; 438/409, 690, 758; 210/491, 500.23, 500.25, 500.26

(56) References Cited

U.S. PATENT DOCUMENTS

| | | | | |
|---|---|---|---|---|
| 4,487,799 A | | 12/1984 | Galasso et al. | |
| 4,499,354 A | | 2/1985 | Hill et al. | |
| 4,976,899 A | * | 12/1990 | Rousseau et al. | 264/29.5 |
| 5,154,970 A | | 10/1992 | Kaplan et al. | |
| 5,298,311 A | * | 3/1994 | Bentson et al. | 428/216 |
| 5,580,388 A | | 12/1996 | Moore | |
| 6,037,032 A | * | 3/2000 | Klett et al. | 428/71 |
| 6,264,045 B1 | * | 7/2001 | Wilson et al. | 210/491 |
| 6,387,343 B1 | | 5/2002 | Klett | |
| 6,413,585 B1 | | 7/2002 | Madec et al. | |
| 6,506,254 B1 | | 1/2003 | Bosch et al. | |

OTHER PUBLICATIONS

Product Information on ULTRA2000 from the Internet.

* cited by examiner

*Primary Examiner*—Quang T. Van
(74) *Attorney, Agent, or Firm*—Kirk A. Wilson

(57) ABSTRACT

An article and method of producing an article for converting energy from one form to another having a pitch-derived graphitic foam carbon foam substrate and a single layer coating applied to all exposed surfaces wherein the coating is either silicon carbide or carbides formed from a Group IVA metal. The article is used as fully coated carbon foam susceptors that more effectively absorb radio frequency (RF) band energy and more effectively convert the RF energy into thermal band energy or sensible heat. The essentially non-permeable coatings also serve as corrosion or oxidation resistant barriers.

8 Claims, 2 Drawing Sheets

HIGH EFFICIENCY, OXIDATION RESISTANT RADIO FREQUENCY SUSCEPTOR

CROSS REFERENCE TO RELATED APPLICATIONS

This application is a continuation of U.S. application Ser. No. 10/082,668 filed Feb. 25, 2002 now abandoned.

STATEMENT REGARDING FEDERALLY SPONSORED RESEARCH OR DEVELOPMENT

The United States Government has rights in this invention pursuant to contract no. DE-AC05-00OR22725 between the United States Department of Energy and UT-Battelle, LLC.

TECHNICAL FIELD

The present invention relates to materials and components capable of absorbing and converting energy, and more particularly to the use of coated carbon foam susceptors that more effectively absorb radio frequency (RF) band energy and more effectively convert the RF energy into thermal band energy or sensible heat. The essentially non-permeable coating infiltrates onto all exposed surfaces of the carbon foam substrate and also serves as a corrosion or oxidation resistant barrier.

BACKGROUND OF THE INVENTION

Typical RF susceptors used in RF furnaces are solid graphite substrate materials coated with a silicon carbide (SiC) layer. However, with the coefficient of thermal expansion of SiC being nearly 4 ppm/° C. and graphite nearly 8 ppm/° C., there is significant problems with spalling and delamination of the coating, resulting in microcracks and porosity in the substrate and coatings. These microcracks permit oxygen to penetrate into the graphite substrate material and results in significant oxidation of the graphite substrate material at 1200° C. Therefore, current SiC coated graphite susceptors have a very limited life for processes involving RF heating in air such as glass manufacturing, optical fiber production, integrated circuit manufacturing, metal refining and forming, and waste incinerators.

U.S. Pat. No. 5,154,970 to Kaplan et al discloses a high temperature resistant reticulated porous foam structure for use as a diesel emission particulate trap. The structure is coated with at least two layers of oxidation resistant coating. However, Kaplan et al. do not teach pitch-derived highly conductive graphitic foam articles having single layer coatings for use as a RF susceptor.

Concurrently filed U.S. patent application entitled "Energy Converting Article and Method of Making" to Klett et al, hereby incorporated by reference, discloses articles similar to the instant invention but with carbon bonded carbon fiber surface coatings and does not teach a material or process wherein the coating is fully infiltrated and selected from the group consisting of silicon carbide and carbides formed from a Group IVA metal.

BRIEF SUMMARY OF THE INVENTION

High conductivity carbon foam has been found to be a very efficient susceptor of radio frequency energy and therefore requires less power to reach high temperatures than does material such as graphite. The foam, when coated with silicon carbide, will also resist oxidation to a greater extent than will silicon carbide-coated graphite because the coating remains more adherent and crack-free, protecting the underlying carbon foam material. This invention reduces the energy needed in heating since the foam absorbs radio frequency energy more efficiently. The coated carbon foam allows the use of the susceptor in oxygen containing environments at very high temperatures, exceeding 1200 degrees Celsius.

Other objects and advantages will be accomplished by the present invention, which is designed to create a pitch derived carbon foam substrate and a coating in intimate thermal and mechanical contact for the efficient absorption of radiation or thermal energy and the efficient conversion and transport of this energy for various engineering purposes.

BRIEF DESCRIPTION OF THE DRAWINGS

Further and other objects and advantages of the present invention will become apparent from the description contained herein, read together with the attached drawings in which.

DETAILED DESCRIPTION OF THE INVENTION

Pitch derived graphite foam is shaped to an appropriate form for application as a susceptor. The foam component is then coated with a single layer of silicon carbide or a metal carbide formed from a Group IVA metal by, for example, chemical vapor deposition (CVD) or chemical vapor infiltration (CVI), to a thickness of approximately 10 to 50 microns. This results in a coating that permeates all surfaces and interstitial spaces of the foam and thereby protects the carbon from oxidation at elevated temperatures. The low modulus of the foam, thin SiC or metal carbide coating and a overall coefficient of thermal expansion of approximately 2 ppm/° C. yield a compliant composite material which resists stress cracking upon heating, thereby leaving an intact oxidation protection coating. The sample is now ready for use as a susceptor.

EXAMPLE 1

A carbon foam preform was machined into dimensions of 25 mm dia.×15 mm thick (mass of 3.21 grams) and placed in a CVD furnace for coating with Silicon Carbide. The sample was heated under vacuum to 1200° C. After steady state was reached, a reactant gas mixture of methyltrichlorosilane at 0.3 g/min and hydrogen at 500 $cm^3$/min was passed over the foam at a partial pressure of 30 torr for 5 hours. After the specified duration, the reactant gases were stopped and the furnace was placed under a vacuum and then cooled to room temperature. The overall final mass was 5.47 grams. Therefore, there was a 2.26 mass gain. Microscopic examination indicated a coating thickness of 10–50 microns throughout the entire volume.

Figure 1:
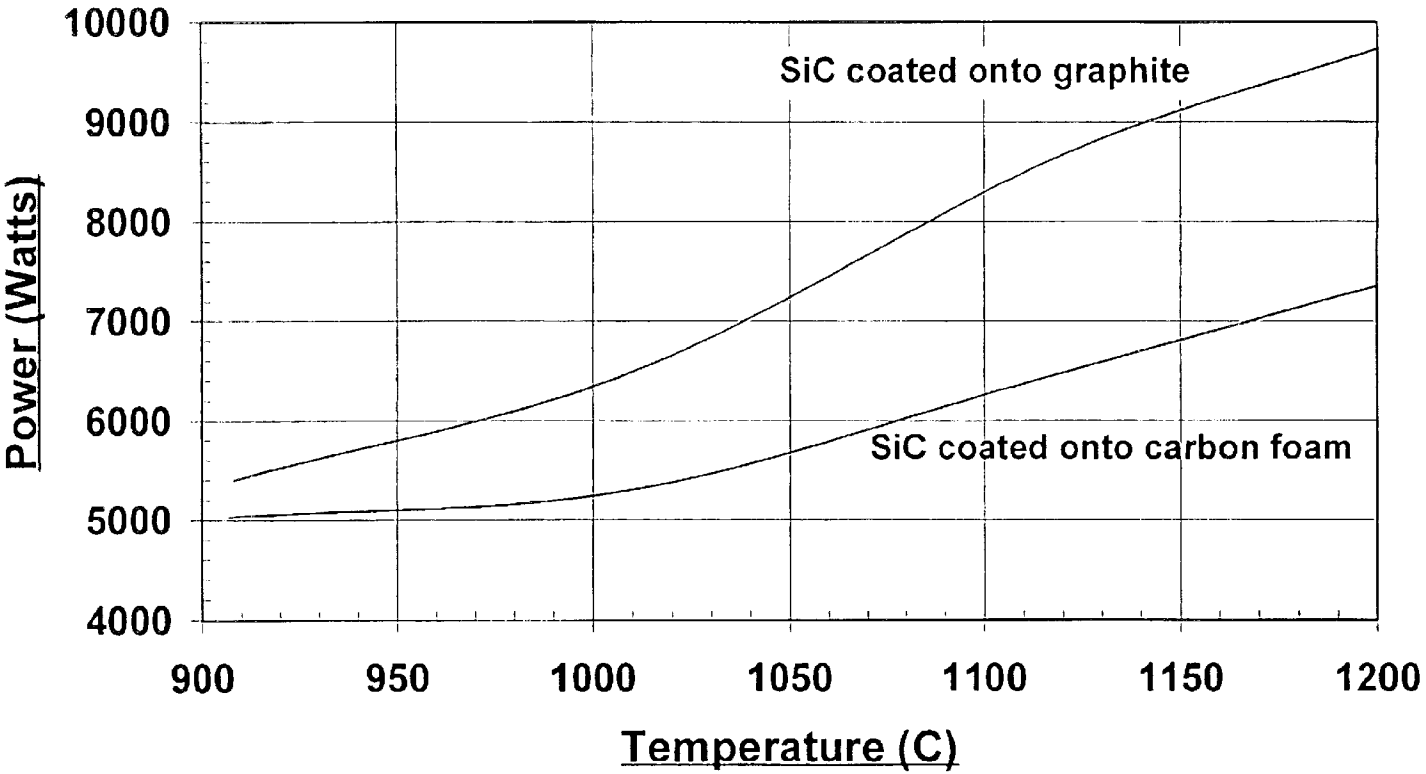
FIG. 1 is a graphed comparison of the power required to heat old SiC coated graphite susceptors and new SiC coated carbon foam susceptors to a desired temperature.
Figure 2:
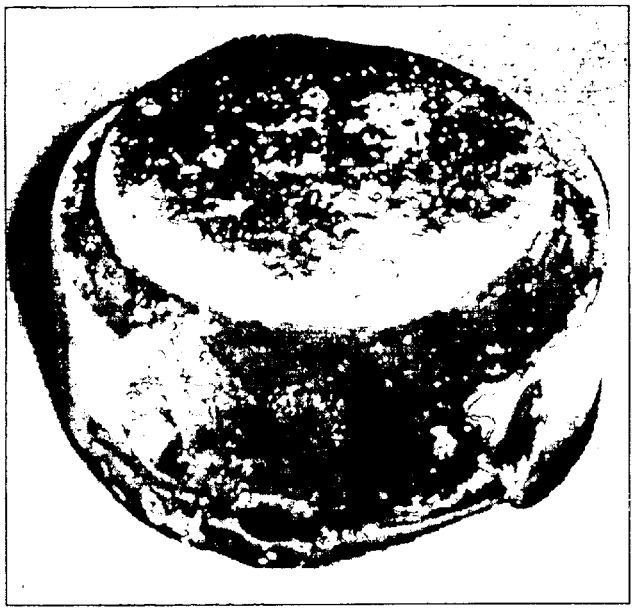
FIG. 2 is a photograph of the old SiC coated graphite susceptor after RF processing.
Figure 3:
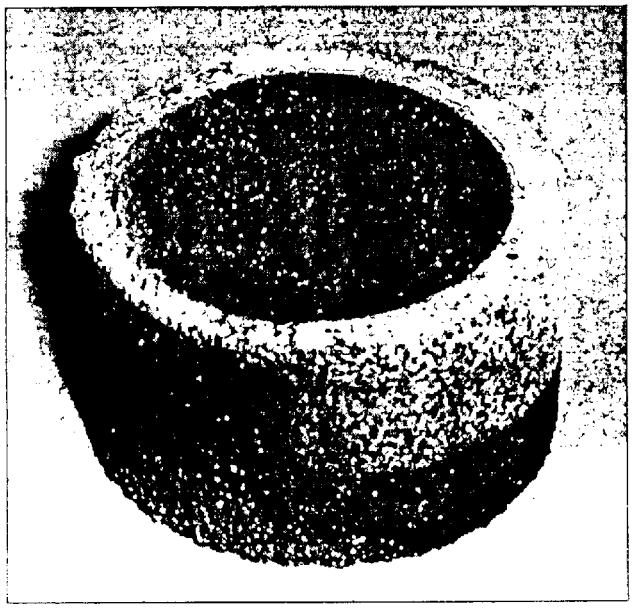
FIG. 3 is a photograph of the new SiC coated carbon foam susceptor after RF processing.

The coated sample was then placed in a RF furnace and placed under the RF loading. The power input versus temperature of the SiC-coated foam susceptor was measured and is plotted in FIG. 1. This same experiment was repeated for a solid graphite susceptor typically used by industry with a 10–50 microns coating of SiC. As can be seen the power levels for the foam susceptor are less than that of a traditional susceptor and therefore the foam is more efficient at converting the energy to heat. FIG. 2 is a picture of the SiC-coated graphite susceptor typical used by industry after RF processing. FIG. 3 is a picture of the SiC-coated carbon foam susceptor after RF processing. As can be seen, the carbon foam susceptor remains intact after RF processing, and the graphite susceptor has delaminated and oxidized in the presence of oxygen.

The single layer coating on the carbon foam is essential to the invention. A single layer on solid graphite does not meet the susceptor criteria, as shown in FIG. 2. The combination of the graphite foam with the single SiC or Group IVA metal layer provides the necessary properties for the susceptor. The low modulus of elasticity of the foam, in the range of approximately 160 to 200 Megapascals (Mpa), versus other foams and even graphites makes the foam very compliant and less susceptible to cracking during thermal gradients and thermal cycling. Also, the very high specific conductivity of the foam, in the range of approximately 100 to 150 Watts/meter-° K (W/m-° K), significantly reduces thermal gradients that contribute to cracking (steady state or cycling).

It will be understood that the inventive articles can also be formed by other techniques similar in principle to the methods described in the foregoing examples. For example, the single layer coating can be plasma sprayed or painted onto the carbon foam, allowing very complex shapes to be coated. It will also be understood that the depth of infiltration can be controlled over a wide range by modifying process variables such as reactant gas flow rates, vacuum readings, processing times, foam pore size, etc. Thus, skilled artisans can achieve the optimal combination of properties for a given application without undue experimentation.

While there has been shown and described what are at present considered the preferred embodiments of the invention, it will be obvious to those skilled in the art that various changes and modifications can be made therein without departing from the scope of the inventions defined by the appended claims.

What is claimed is:

1. An article for converting energy from one form to another comprising;

a) a pitch-derived graphitic foam carbon foam substrate, and b) a single layer coating infiltrated and deposited to all exposed surfaces of said substrate wherein said single layer coating is selected from the group consisting of silicon carbide and carbides formed from a Group IVA metal.

2. An article in accordance with claim 1 wherein said energy conversion comprises at least one of the following:

a) the conversion of RF energy to sensible heat;

b) the conversion of absorbed radiant energy to sensible heat;

c) the conversion of sensible heat to radiant energy; and, d) the conversion of electron kinetic energy to sensible heat.

3. An article in accordance with claim 1 wherein said carbon foam substrate has a modulus of elasticity in the range of approximately 160 to 200 Mpa.

4. An article in accordance with claim 1 wherein said carbon foam substrate has a specific conductivity in the range of approximately 100 to 150 W/m-° K.

5. An article in accordance with claim 1 wherein said coating substantially coats the pores of said carbon foam to a thickness in the range of approximately 10 to 50 microns.

6. An article in accordance with claim 1 wherein said article has an overall coefficient of thermal expansion of approximately 2 ppm/° C.

7. An article in accordance with claim 1 wherein said single layer coating is applied using at least one technique selected from the group consisting of chemical vapor deposition, chemical vapor infiltration, plasma spraying, and painting.

8. An article in accordance with claim 1 wherein said article is a radio frequency susceptor.

* * * * *